US006361347B1

(12) United States Patent
Murakami et al.

(10) Patent No.: US 6,361,347 B1
(45) Date of Patent: Mar. 26, 2002

(54) HALF-FITTING PREVENTION CONNECTOR WHICH POSITIVELY PREVENTS A HALF-FITTED CONNECTION

(75) Inventors: Takao Murakami; Masaru Fukuda, both of Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/650,638

(22) Filed: Aug. 30, 2000

(30) Foreign Application Priority Data

Aug. 30, 1999 (JP) ..... 11-243940

(51) Int. Cl.[7] ..... H01R 13/627
(52) U.S. Cl. ..... 439/352; 439/489; 439/357
(58) Field of Search ..... 439/159, 350, 439/352, 353, 357, 489, 358, 595

(56) References Cited

U.S. PATENT DOCUMENTS

| | | | | |
|---|---|---|---|---|
| 5,183,410 A | | 2/1993 | Inaba et al. | 439/489 |
| 5,820,399 A | | 10/1998 | Sirouzu et al. | 439/352 |
| 5,919,056 A | * | 7/1999 | Suzuki et al. | 439/352 |
| 6,059,597 A | * | 5/2000 | Endo et al. | 439/352 |

FOREIGN PATENT DOCUMENTS

| | | | |
|---|---|---|---|
| EP | 0 789 425 A2 | 8/1997 | H01R/13/629 |
| EP | 0 841 724 A2 | 5/1998 | H01R/13/629 |
| EP | 0 926 773 A1 | 6/1999 | H01R/13/453 |
| JP | 4-306575 | 10/1992 | H01R/13/62 |
| JP | 10-50408 | 2/1998 | H01R/13/639 |

* cited by examiner

*Primary Examiner*—Paula Bradley
*Assistant Examiner*—Truc Nguyen
(74) *Attorney, Agent, or Firm*—Sughrue Mion, PLLC

(57) ABSTRACT

In a half-fitting prevention connector (1), a lock arm (10), having an engagement projection (9) for retaining a mating connector (3), is elastically-deformably supported in a housing (4), and a receiving chamber (11), in which a spring member (5) is held, is formed within the lock arm (10). The spring member (5) includes a coil-shaped compression spring portion (6), and a rear end portion of this compression spring portion is twisted perpendicularly to an axis thereof to form a torsion spring portion (7), and a resiliently-bendable portion (8) extends obliquely forwardly from this torsion spring portion. The receiving chamber (11) has a movement-enabling space (13). The mating connector (3) has pressing portions (24) which abut against the spring member (5) to compress the same during a fitting operation. An abutment portion (31) and a retaining portion (32), which abuts against and retains the distal end of the resiliently-bendable portion (8), are formed on a reverse surface of the engagement projection (9). A gap (δ) is formed between a front holding portion (18) in the receiving chamber (11) and the front end of the compression spring portion (6).

7 Claims, 14 Drawing Sheets

1
2
3
4
5
6
7
8
9
10
11
12
13
14
18
19
20
21
22
23
24
25
31
32
41
42
W
W
δ

HALF-FITTING PREVENTION CONNECTOR WHICH POSITIVELY PREVENTS A HALF-FITTED CONNECTION

BACKGROUND OF THE INVENTION

1. Field of the Invention

The present invention relates to a half-fitting prevention connector in which a half-fitted condition is positively prevented by a resilient force of a spring member mounted in a housing of at least one of a pair of male and female connectors to be fitted together, and the connector, fitted on the mating connector is positively locked.

The present application is based on Japanese Patent Application No. Hei. 11-243940, which is incorporated herein by reference.

2. Description of the Related Art

Various half-fitting prevention connectors have been known. One such example is shown in FIGS. 9 to 15. This conventional half-fitting prevention connector will now be described with reference to FIGS. 9 to 15.

As shown in FIGS. 9 and 10, the conventional half-fitting prevention connector 51 comprises a pair of male and female connectors 52 and 53 to be fitted together, and an exclusive-use housing 55 is formed integrally on an upper side of a housing 54 of the male connector 52, and spring receiving portions 56 are formed respectively at opposite side portions of the exclusive-use housing 55, and a pair of compression springs 57 are received in the spring receiving portions 56, respectively, and a half-fitted condition of the male and female connectors 52 and 53 is prevented by a resilient force of these compression springs 57.

The male connector includes a lock arm 58 elastically-deformably supported in the housing 54, and an engagement projection 59 for retaining the mating female connector 53 is formed on a lower surface of this lock arm 58 at a distal end thereof. A slider 62 is slidably mounted within the exclusive-use housing 55.

Displacement prevention projections 60 are formed on the upper surface of the lock arm 58 facing away from the engagement projection 59, and a lock beak 61 is formed on the upper surface of the lock arm 58 at a proximal end portion thereof. The exclusive-use housing 55 is originally intended to support the slider 62 in a manner to allow an axial sliding movement of this slider, and most of the exclusive-use housing 55 is formed into an upwardly-open slider receiving portion 63. Side spaces 64, as well as guide grooves 65, are provided at opposite sides of the lock arm 58, respectively, so that the slider 62 can slide in straddling relation to the lock arm 58.

The slider 62 includes a slider body 66 which can slide while guided by the guide grooves 65. Spring retaining portions 67 are formed respectively on opposite side portions of a front end of the slider body 66, and each of these spring retaining portions 67 is engaged with the associated compression spring 57 so as to compress the same toward the spring receiving portion 56 in the guide groove 65. A U-shaped notch 68 is formed in the slider body 66, so that the slider body 66 has a slider arm 69 which can be elastically deformed or turned upwardly about its rear end. A pair of abutment projections 70 are formed on a lower surface of the slider arm 69 at a front end thereof, and can slide in the side spaces 64, respectively.

A recess-like displacement prevention portion 71 is formed in the lower surface of the front end portion of the slider body 66, and the displacement prevention projections 60 can abut against the displacement prevention portion 71 to prevent the displacement of the lock arm 58. A pressing portion 72 is formed on the upper surface of the rear end portion of the slider body 66, and this pressing portion 72 can be pressed rearwardly by the finger. A slide groove 73 in the form of a rectangular hole is formed in a central portion of the slider arm 69, and is disposed forwardly of the pressing portion 72, and the lock beak 61 can move back and forth in this slide groove 73.

A male connector housing 74 is formed at a lower portion of the housing 54, and can be fitted into a female connector housing 76.

A slanting projection 77 for retaining engagement with the engagement projection 59 is formed on an upper surface of a female housing 75, and a pair of stopper projections 78 for abutting respectively against the abutment projections 70 on the slider 62 are formed on the upper surface of the female housing 75.

In the half-fitting prevention connector 51 of the above construction, first, the pair of compression springs 57 are inserted respectively into the spring receiving portions 56 formed at the rear end portion of the exclusive-use housing 55 of the male connector 52 as shown in FIG. 9, and then when the slider 62 is inserted into the exclusive-use housing 55 along the guide grooves 65, the lower side of the front end portion of the pressing portion 72 slides over the lock beak 61 while elastically deforming the lock arm 58 downwardly. Then, when the application of the insertion force is stopped as shown in FIG. 11, the front end of the pressing portion 72 of the slider 62, urged forward by the compression springs 57, abuts against the lock beak 61, so that the slider 62 is set or positioned in the housing 54.

Then, female terminals 41, each connected at its rear end to a sheathed wire W, are inserted into the male connector housing 74, and also male terminals 42, each connected to a sheathed wire W, are inserted deep into the female connector housing 76.

Then, the male and female connectors 52 and 53 are arranged in opposed relation to each other, and are pushed in a fitting direction, as shown in FIG. 11. As a result, the stopper projections 78 on the housing 75 abut respectively against the abutment projections 70 on the slider 62, so that the slider 62 is moved toward the rear end of the housing 54 while compressing the compression springs 57. Then, the engagement projection 59 slides over the slanting projection 77, so that the lock arm 58 is elastically deformed upwardly, and the slider arm 69 slides over the lock beak 61 to be elastically deformed upwardly.

At this stage, when the application of the fitting force to the male and female connectors 52 and 53 is stopped, the slider 62 is returned by the resilient force of the compression springs 57, and therefore the female connector 53 is pushed back through the abutment projections 70 and the stopper projections 78.

Therefore, a half-fitted condition is prevented from being maintained. In this half-fitted condition, the pressing portion 72 is located at the rear end of the exclusive-use housing 55 as shown in FIG. 12, and this half-fitted condition can also be confirmed with the eyes since the exclusive-use housing 55 has the open top.

When the fitting operation further proceeds as shown in FIG. 13, the slider arm 69 is further elastically deformed upwardly by the lock beak 61, so that the abutment projections 70 are disengaged from the stopper projections 78, respectively. As a result, the slider 62 is returned forward by the resilient force of the compression springs 57, and is stopped when the front end of the pressing portion 72 is brought into abutting engagement with the lock beak 61.

At this time, the engagement projection 59 is retained by the slanting projection 77, and therefore the elastically-deformed lock arm 58 is restored into its original shape, and also the displacement prevention portion 71 of the restored slider 62 rests on the displacement prevention projections 60 on the lock arm 58. Therefore, the lock arm 58 is locked against elastic deformation, and this completely-fitted condition can be confirmed by viewing the position of the pressing portion 72.

For canceling the fitting connection between the male and female connectors 52 and 53 (see FIG. 14), the housing 75 is held with the hand, and the pressing portion 72 is pulled with the finger while compressing the compression springs 57. As a result, the slider 62 is moved rearward, so that the displacement prevention portion 71 is brought out of locking engagement with the displacement prevention projections 60. Then, the abutment projections 70 slide over the stopper projections 78, respectively, so that the slider arm 69 begins to be elastically deformed upwardly.

When the pressing portion 72 is further pulled as shown in FIG. 15, the distal end portion of the slider arm 69 slides over the lock beak 61, and at the same time the engagement projection 59 is brought out of locking engagement with the slanting projection 77, and therefore the fitting connection between the male and female connectors 52 and 53 is canceled.

In the above conventional half-fitting prevention connector, however, the provision of the slider 62 is necessary, and therefore the number of the component parts increases, which has invited a problem that the cost increases.

And besides, when the pressing portion 72 is pulled rearward so as to cancel the fitting connection, this pulling operation must be done while compressing the compression springs, and therefore there has been encountered a problem that the efficiency of the canceling operation can not be enhanced.

Furthermore, a small clearance need to be provided between the inner periphery of the spring receiving portion 56 (and the inner periphery of the guide groove 65) and the outer periphery of the compression spring 57 so as to ensure the operation, and therefore when the resilient force, produced by each compression spring 57, is at a low level, there has been a possibility that noises are produced, for example, by the vibration of a vehicle.

Furthermore, when the connector is shifted from the half-fitted condition to the completely-fitted condition, the compression springs 57 push the slider 62 to return the same into the set condition. Since each compression spring 57 is held against the rear end of the spring receiving portion 56 and the rear end of the slider body 66, an impact is transmitted to part of the housing 54, and can damage it.

SUMMARY OF THE INVENTION

With the above problems in view, it is an object of the present invention to provide a half-fitting prevention connector in which the number of component parts is small, and the efficiency of a canceling operation is good, and the production of noises due to vibrations and others is prevented, and an impact, produced when effecting a fitting operation, is low.

To achieve the above object, according to the first aspect of the present invention, there is provided a half-fitting prevention connector which comprises a first connector housing, a second connector housing fittable to the first connector housing, a spring member receivable in the first connector housing, wherein a half-fitted condition of the first and second connector housings is prevented by a resilient force of the spring member, a lock arm elastically-deformably supported on the first connector housing, the lock arm having an engagement projection for retaining the second connector housing, a receiving chamber, in which the spring member is held, formed within the lock arm, the receiving chamber having a movement-enabling space for allowing movement of the spring member, and a pressing portion disposed on the second connector housing, the pressing portion abutting against the spring member to compress the spring member when the lock arm is elastically displaced during a fitting operation of the first and second connector housings, wherein when canceling a locked condition of the lock arm, the spring member does not follow an elastic displacement of the lock arm.

According to the second aspect of the present invention, it is preferable that the spring member includes a coil-shaped compression spring portion, a torsion spring portion, wherein a rear end portion of the compression spring portion is twisted perpendicularly to an axis thereof to form the torsion spring portion, and a resiliently-bendable portion extending obliquely forwardly from the torsion spring portion.

According to the third aspect of the present invention, the half-fitting prevention connector may further comprise an abutment portion abutted against a distal end of the resiliently-bendable portion, and a rear holding portion holding the torsion spring portion in a predetermined direction, wherein the abutment portion and the rear holding portion are disposed in the receiving chamber.

Alternatively, according to the fourth aspect of the present invention, the spring member may include a compression spring portion comprising a strip bent into a zigzag shape, a folded-back portion formed at a rear end of the compression spring portion, and a strip-like, resiliently-bendable portion extending obliquely forwardly from the folded-back portion.

In this case, according to the fifth aspect of the present invention, it is preferable that the half-fitting prevention connector further comprises an abutment portion abutted against a distal end of the resiliently-bendable portion, and a rear holding portion holding the folded-back portion in a predetermined direction, wherein the abutment portion and the rear holding portion are disposed in the receiving chamber.

According to the sixth aspect of the present invention, it is preferable that when the spring member is held in a free condition between the rear holding portion and a front holding portion within the receiving chamber, a gap is formed between a front end of the spring member and the front holding portion, wherein a retaining portion, which retains a front end of the resiliently-bendable portion, is formed at the abutment portion.

In the half-fitting prevention connector of the above construction, the receiving chamber, in which the spring member is held, is formed within the lock arm, and the receiving chamber has the movement-enabling space, and the mating connector has the pressing portion which abuts against the spring member to compress the same when the lock arm is elastically displaced during the fitting operation. Therefore, the provision of a slider is not necessary, and the number of the component parts is reduced. Therefore, the construction is simplified, and the cost can be reduced.

And besides, when canceling the locked condition, the spring member does not follow the elastic displacement of the lock arm. Therefore, when canceling the fitting connection, it is not necessary to pull the engagement projection back against the bias of the spring member, and therefore the fitting connection-canceling operation is easy. Therefore, the efficiency of the fitting connection-canceling operation is enhanced.

The spring member includes the coil-shaped compression spring portion 6, and the rear end portion of this compression spring portion is twisted perpendicularly to the axis thereof to form the torsion spring portion, and the resiliently-bendable portion extends obliquely forwardly from the torsion spring portion. Therefore, the spring member can be pressed against the bottom of the receiving chamber by this resiliently-bendable portion. Therefore, noises will not be produced by vibrations of a vehicle and other factors, and there can be obtained the half-fitting prevention connector of high reliability.

Alternatively, the spring member includes the compression spring portion, comprising a strip bent into a zigzag (or corrugated) shape, the folded-back portion formed at the rear end of the compression spring portion, and the strip-like, resiliently-bendable portion extending obliquely forwardly from the folded-back portion. With this construction, the productivity of the spring members can be enhanced.

The abutment portion, abutted against the distal end of the resiliently-bendable portion, and the rear holding portion, holding the torsion spring portion or the folded-back portion in the predetermined direction, are provided in the receiving chamber. Thus, the direction of the resiliently-bendable portion is fixed, and therefore the spring member can be positively pressed against the bottom of the receiving chamber. Therefore, noises will not be produced by vibrations of the vehicle and other factors, so that the reliability of the half-fitting prevention connector is further enhanced.

When the spring member is held in a free condition between the rear holding portion and the front holding portion within the receiving chamber, the gap is formed between the front end of the spring member and the front holding portion, and the retaining portion, which retains the front end of the resiliently-bendable portion, is formed at the abutment portion. When the connector is shifted from the half-fitted condition to the completely-fitted condition, the spring member is disengaged from the pressing projection, and is restored into the set condition. The spring member is retained by the retaining portion, and since the gap is formed between the front end of the spring member and the front holding portion, a impact force, produced when the front end of the spring member impinges on the front holding portion, is reduced. Therefore, the lock arm and the housing will not be damaged by such an impact transmitted thereto, and the durability and reliability are enhanced.

DETAILED DESCRIPTION OF THE PREFERRED EMBODIMENT

Figure 1:
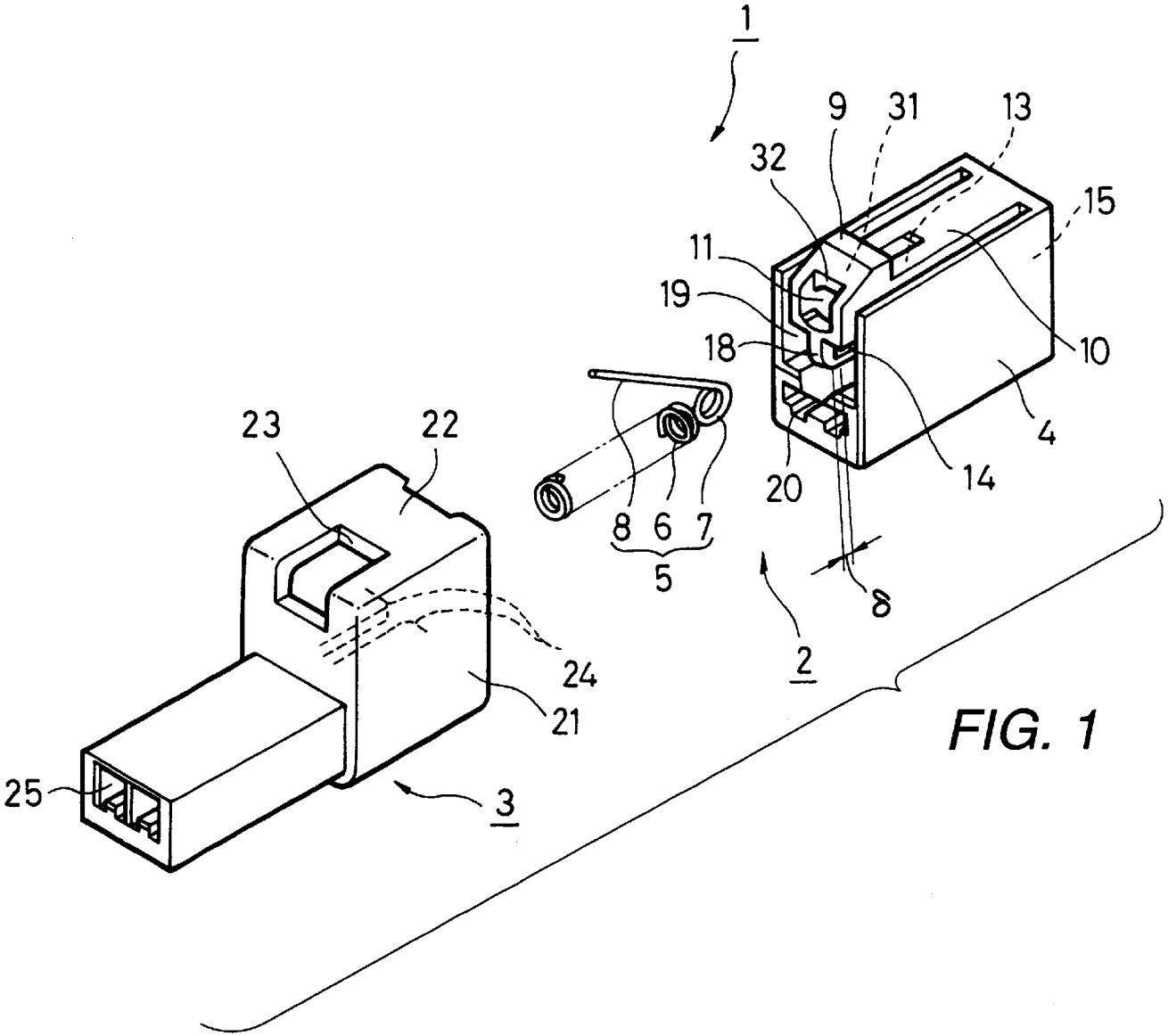
FIG. 1 is an exploded, perspective view of one preferred embodiment of a half-fitting prevention connector of the present invention.
Figure 2:
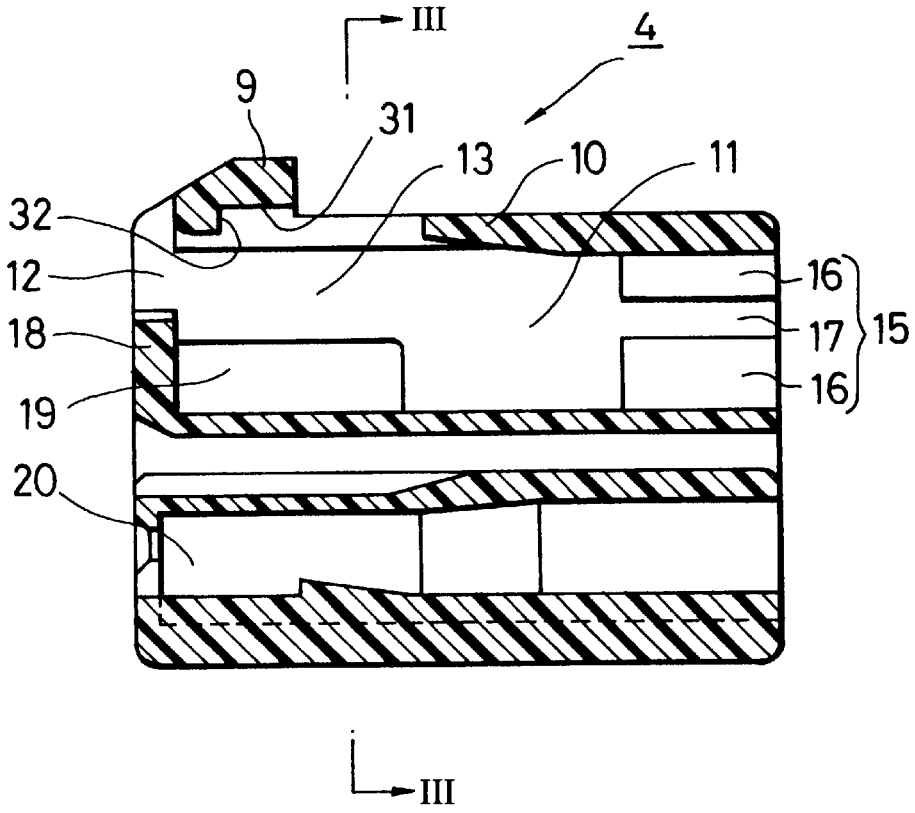
FIG. 2 is a cross-sectional view of a housing of a male connector of FIG. 1.

One preferred embodiment of a half-fitting prevention connector of the present invention will now be described in detail with reference to FIGS. 1 to 8.

As shown in FIGS. 1 to 4, in the half-fitting prevention connector 1 of this embodiment, a half-fitted condition of a pair of male and female connectors 2 and 3 to be fitted together is prevented by a resilient force of a spring member 5 received in a housing (4) of one (2) of the two connectors 2 and 3. A lock arm 10, having an engagement projection 9 for retaining the mating connector 3, is elastically-deformably supported in the housing 4.

Figure 3:
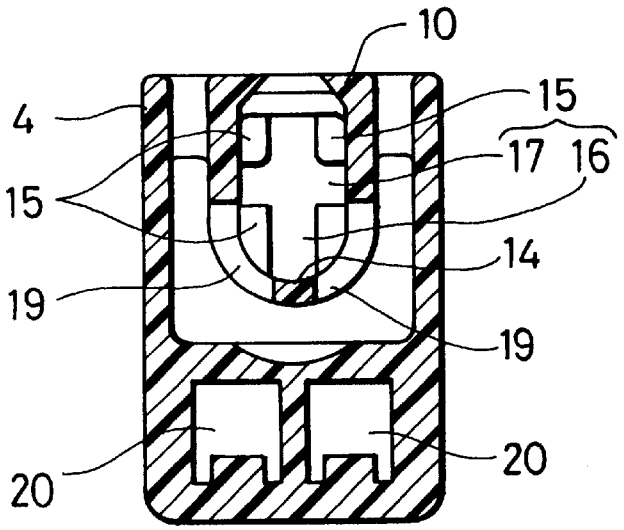
FIG. 3 is a cross-sectional view taken along the line III—III of FIG. 2.

A receiving chamber 11 for holding the spring member 5 therein is formed within the lock arm 10, and this receiving chamber 11 includes an insertion port 12 for the spring member 5, a movement-enabling space 13, and a bottom 14. As shown in FIG. 3, a rear holding portion 15 is formed at a rear end of the receiving chamber 11, and a vertical groove 16 and a horizontal groove 17 are formed in this rear holding portion 15 in intersecting relation to each other. This rear holding portion 15 serves to hold the spring member 5 in a predetermined direction.

A front holding portion 18 is formed at a front end of the receiving chamber 11 in an upstanding manner. A lower portion of the front end portion of the receiving chamber 11 is made open at opposite sides thereof by notches 19, and a pair of pressing projections 24 on the female connector 3 (described later) can enter these notches 19, respectively. Terminal receiving chambers 20 are formed in a lower portion of the housing 4 disposed below the receiving chamber 11.

The female connector 3 includes a housing 21 for fitting on the housing 4, and an engagement plate 22 and an engagement window 23 for engagement with the engagement projection 9 are provided at an upper portion of this housing 21. The pair of pressing projections 24 are provided within the housing 4, and project forwardly. When the lock arm 10 is elastically displaced during the fitting operation, the pressing projections 24 abut against the front end of the spring member 5 to compress the same. Terminal receiving chambers 25 are provided at a lower portion of the housing 21, and extend rearwardly.

The spring member 5 includes a coil-shaped compression spring portion 6, and a rear end portion of this compression spring portion 6 is twisted perpendicularly to an axis thereof to form a torsion spring portion 7, and a resiliently-bendable portion 8 extends obliquely forwardly from the torsion spring portion 7. This spring member 5 can be replaced by a spring member 35 (shown in FIG. 8) which includes a compression spring portion 36, comprising a strip bent into a zigzag (or corrugated) shape, a folded-back portion 37 formed at a rear end of the compression spring portion 36, and a strip-like, resiliently-bendable portion 38 extending obliquely forwardly from the folded-back portion 37.

When the spring member 5 is held in a free condition between the rear holding portion 15 and the front holding portion 18 within the receiving chamber 11, a gap δ is formed between the front end of the spring member 5 and the front holding portion 18. An abutment portion 31 is formed at the reverse surface (inner surface) of the engagement projection 9, and a distal end of the resiliently-bendable portion 8 is held against this abutment portion 31. A retaining portion 32, which retains the front end of the resiliently-bendable portion 8, is formed at a front end of the abutment portion 31.

Figure 4:
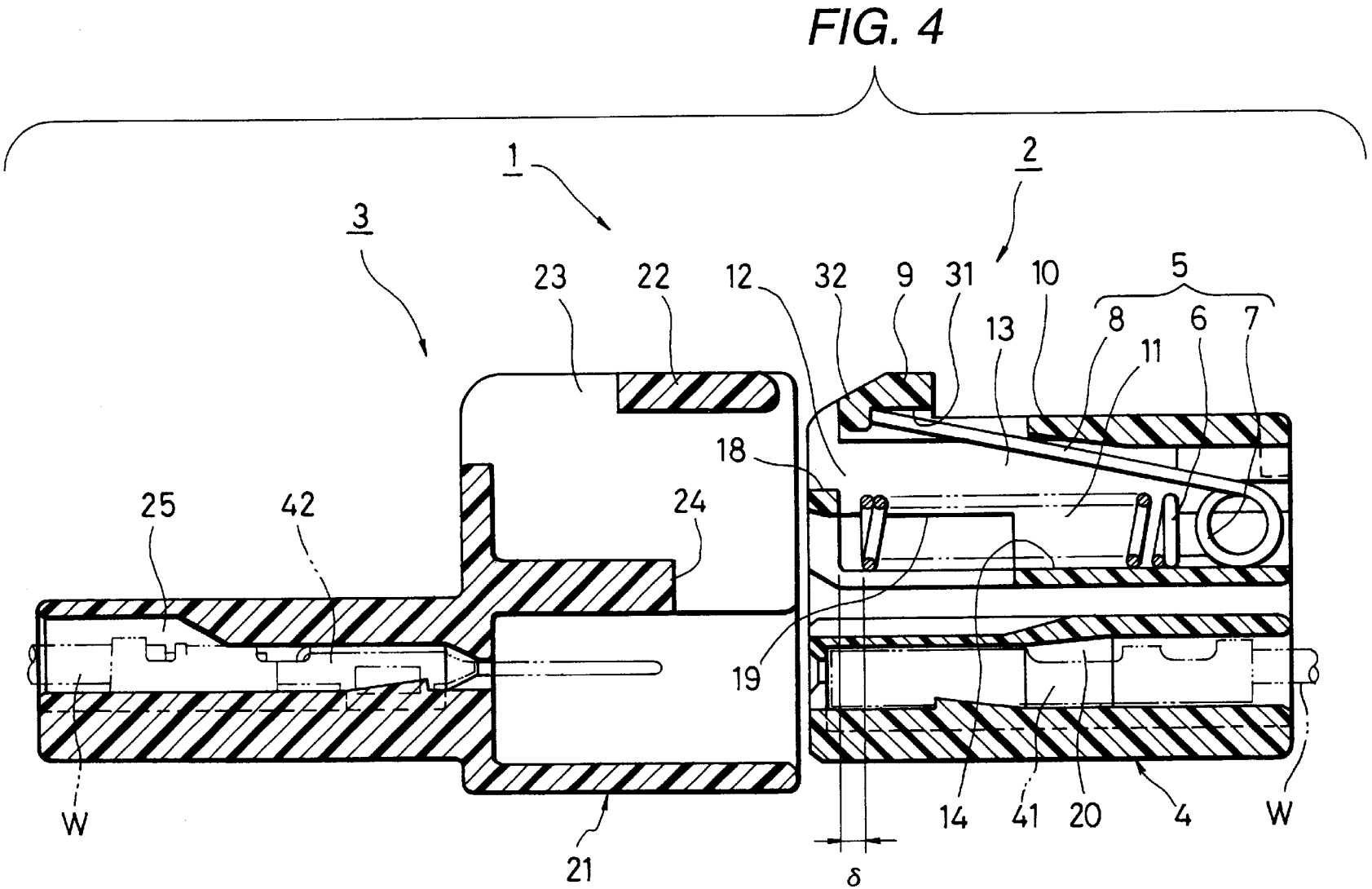
FIG. 4 is a cross-sectional view of the connector of FIG. 1, showing a condition before a fitting operation is started.

In the half-fitting prevention connector 1 of the above construction, first, the spring member 5 is inserted into the receiving chamber 11 through the insertion port 12 in the lock arm 10 of the housing 4, with the resiliently-bendable portion 8 directed upwardly, as shown in FIG. 4. As a result, the torsion spring portion 7 is held in the vertical groove 16 in the rear holding portion 15 (In the case of the spring member 35, its rear end is held in the horizontal groove 17), and at the same time the distal end of the resiliently-bendable portion 8 is held against the abutment portion 31, and is retained by the retaining portion 32.

By the resilient force of the resiliently-bendable portion 8, the compression spring portion 6 is moved downwardly from the movement-enabling space 13, and is stably pressed against the bottom 14. Female terminals 41, each connected to a sheathed wire W, are inserted respectively into the terminal receiving chambers 20 from the rear side, and are retained by respective lances or the like. Also, male terminals 42, each connected to a sheathed wire W, are inserted respectively into the terminal receiving chambers 25 provided at the rear portion of the housing 21, and are retained by respective lances or the like.

Figure 5:
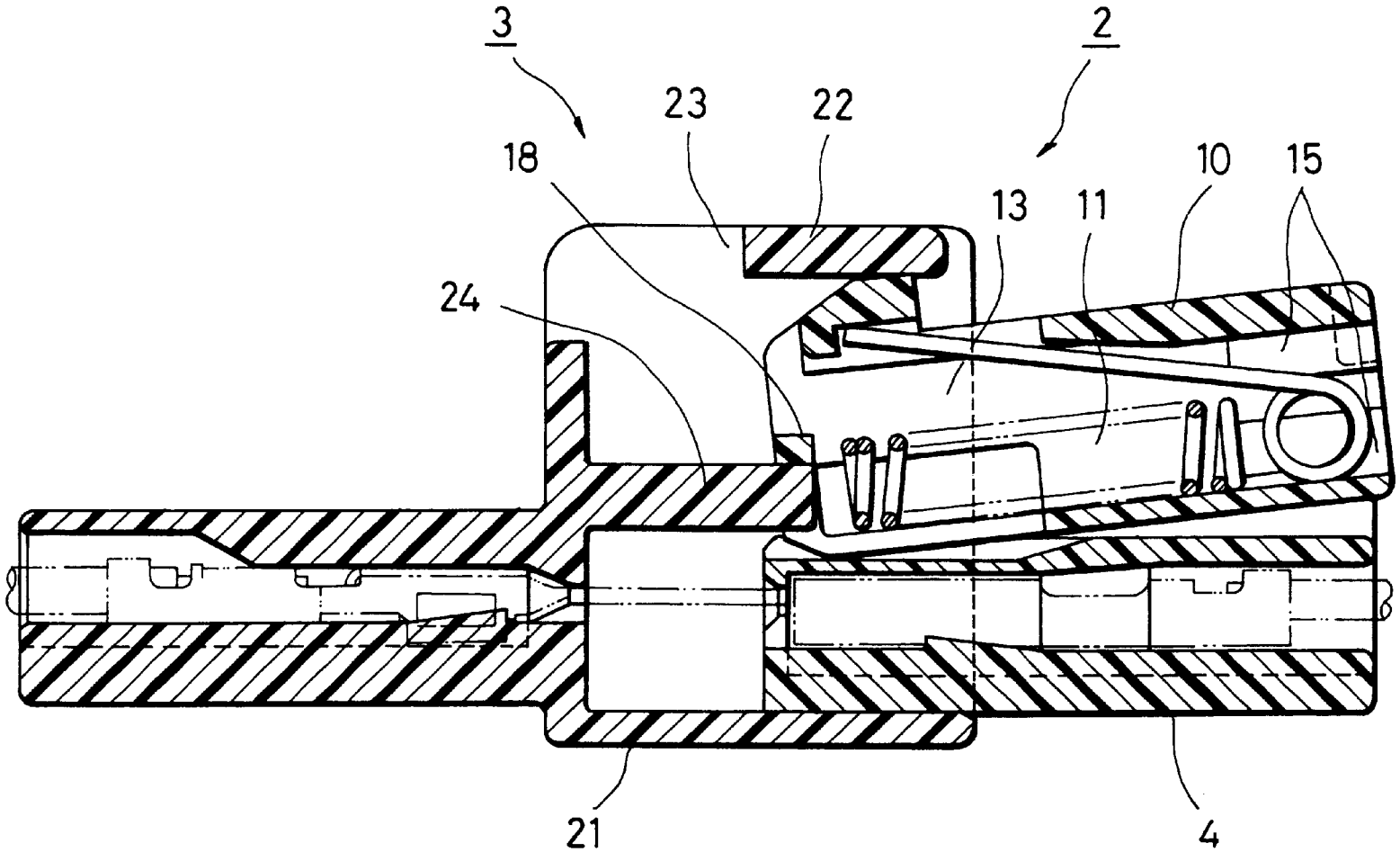
FIG. 5 is a view showing the connector of FIG. 1 at an initial stage of the fitting operation.

Next, the fitting operation will be described with reference to FIGS. 4 to 7. First, the male and female connectors 2 and 3 are opposed to each other as shown in FIG. 4, and then are pushed in a fitting direction. As a result, a slanting surface at the front end of the engagement projection 9 abuts against the inner surface of the engagement plate 22, so that the lock arm 10 is elastically deformed downwardly together with the spring member 5, as shown in FIG. 5.

Figure 6:
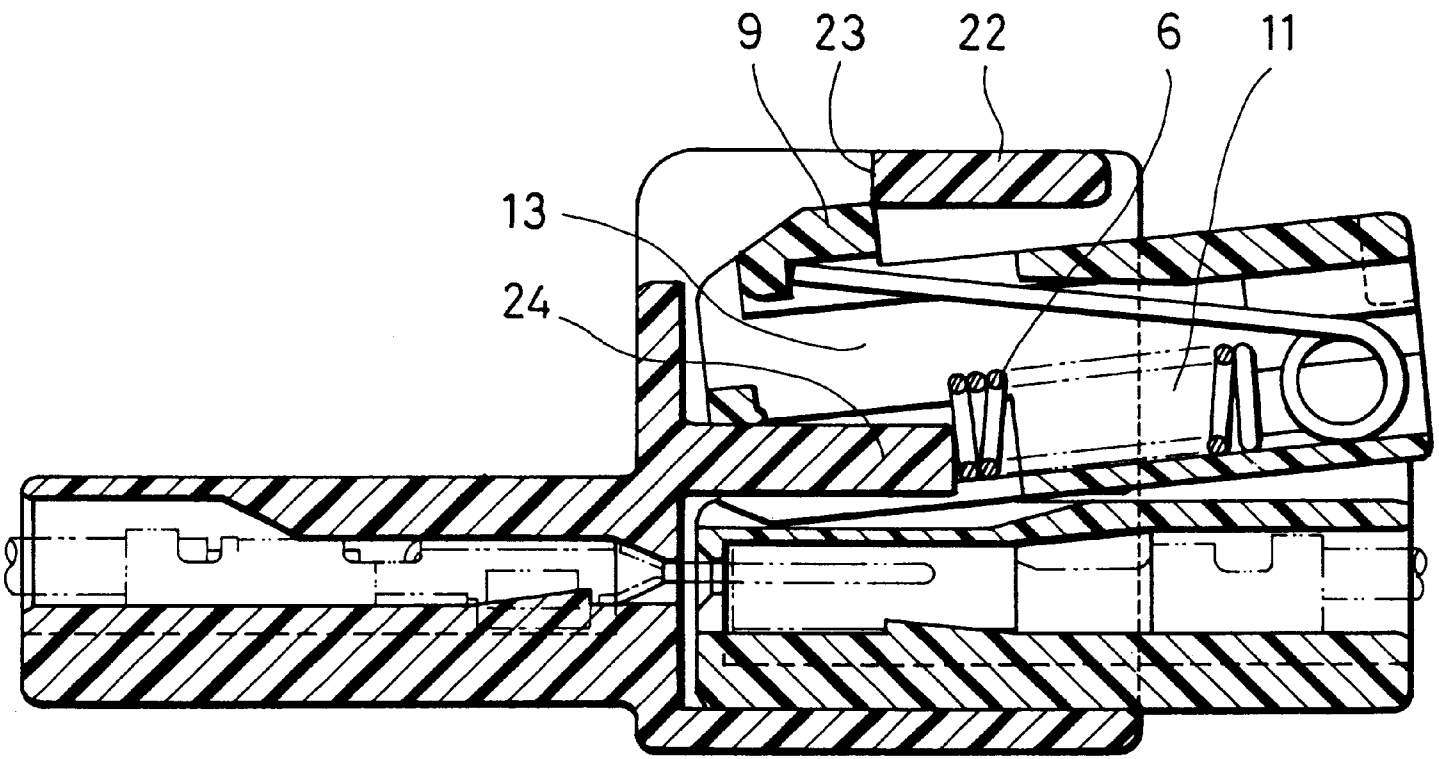
FIG. 6 is a view showing a final stage of a half-fitted condition of the connector of FIG. 1.

When the fitting operation further proceeds, the front end of the compression spring portion 6 abuts against the front ends of the pressing projections 24 as shown in FIG. 6, so that the compression spring portion 6 is compressed, and therefore its resilient force, acting in an anti-fitting direction, gradually increases. The fitting operation proceeds immediately before the engagement projection 9 is disengaged from the inner surface of the engagement plate 22. This condition is a final stage of a half-fitted condition, and when the application of the fitting force is canceled before this stage, the female connector 3 is returned by the resilient force of the compression spring portion 6, thereby preventing the half-fitting connection.

Figure 7:
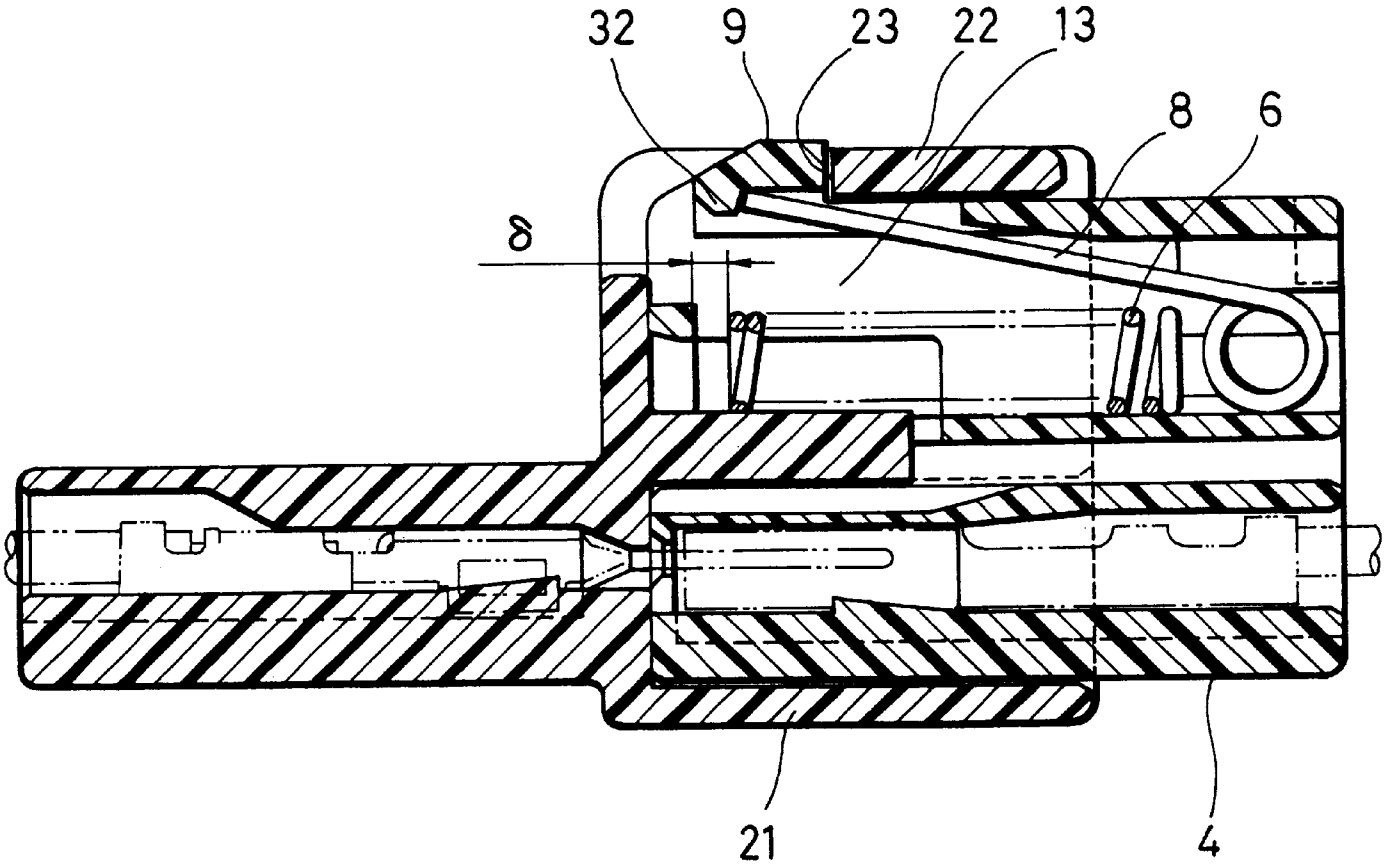
FIG. 7 is a cross-sectional view of the connector of FIG. 1 in a completely-fitted condition.
Figure 8:
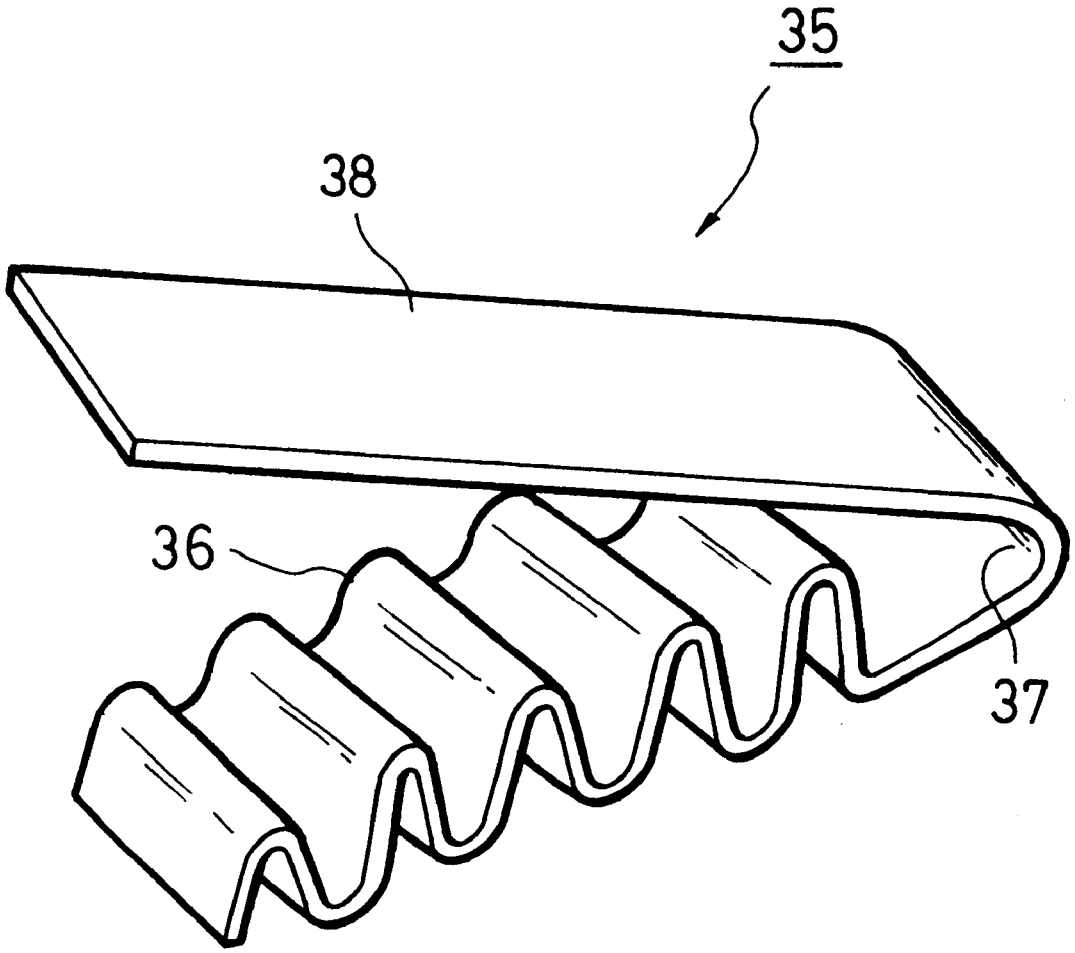
FIG. 8 is a perspective view of a modified spring member to be used in the connector of FIG. 1.
Figure 9:
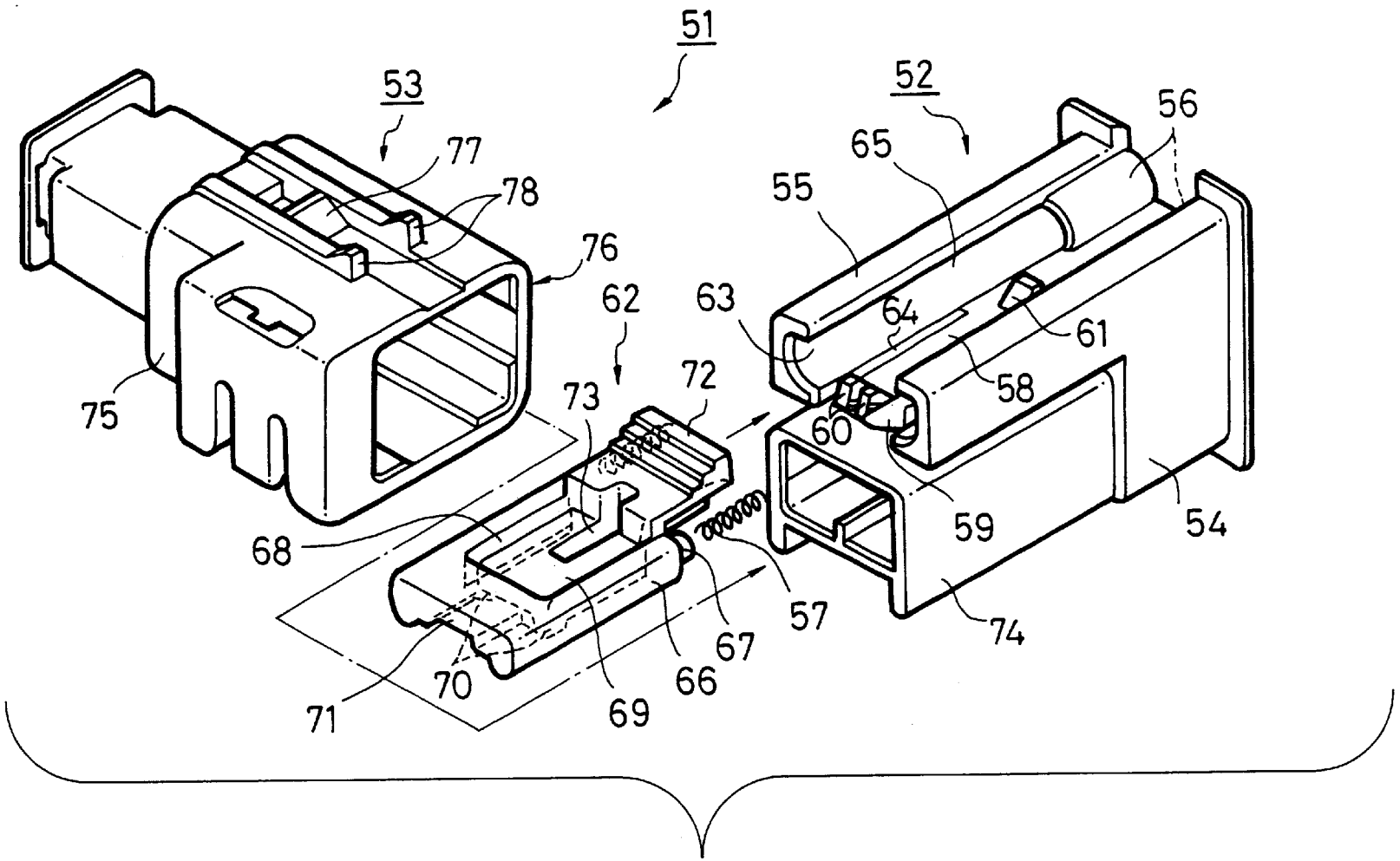
FIG. 9 PRIOR ART
FIG. 9 is an exploded, perspective view of a conventional half-fitting prevention connector.
Figure 10:
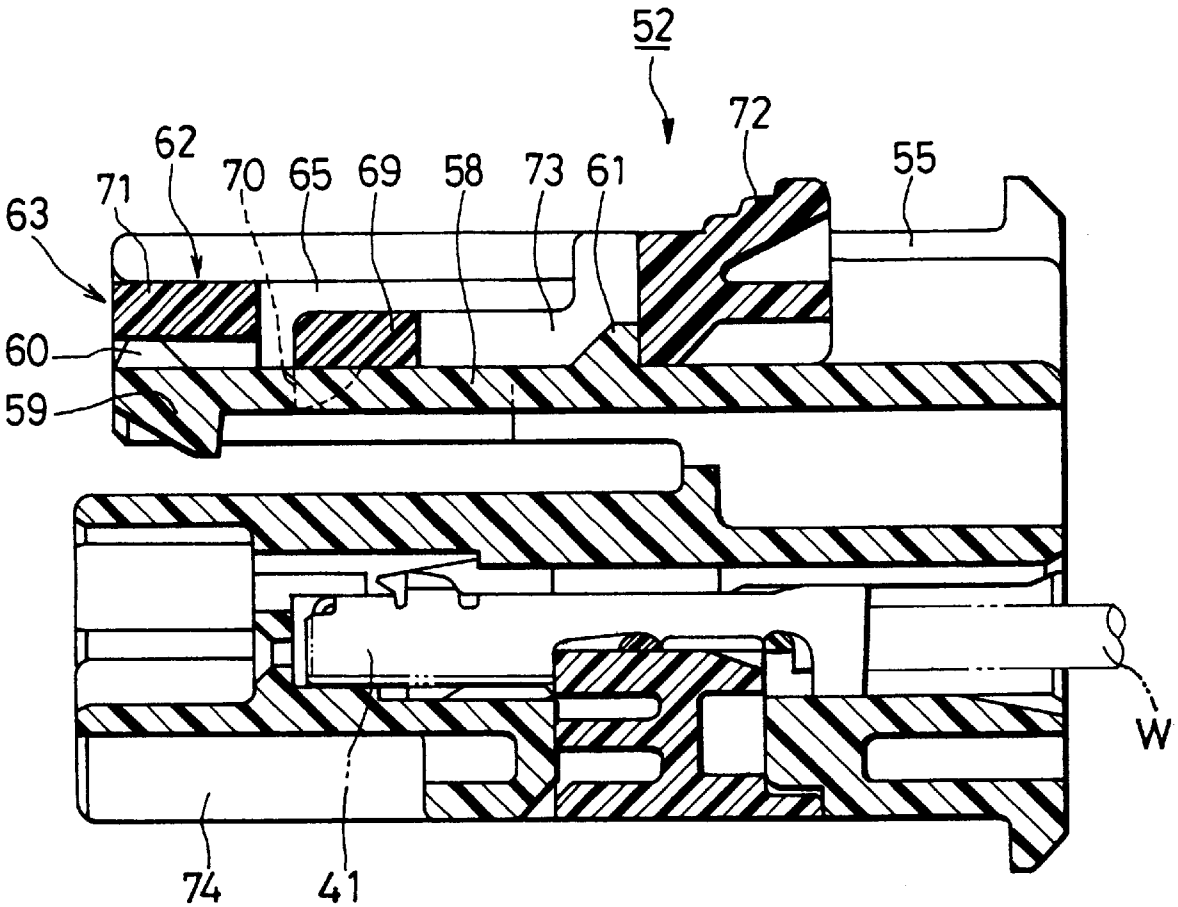
FIG. 10 PRIOR ART
FIG. 10 is a cross-sectional view of a male connector of FIG. 9, having a slider received therein.
Figure 11:
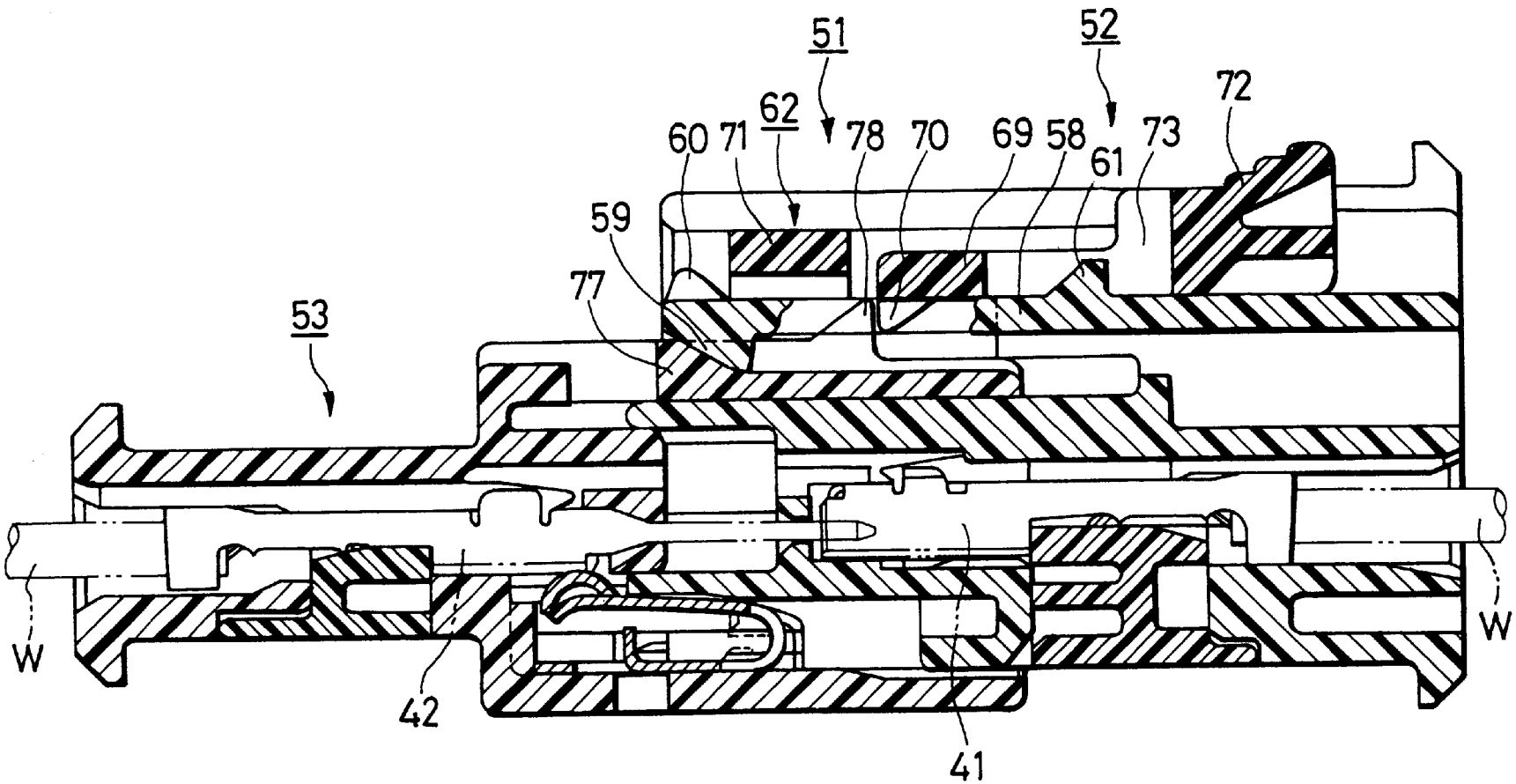
FIG. 11 PRIOR ART
FIG. 11 is a cross-sectional view of the connector of FIG. 9, showing a condition in which the male and female connectors begin to be fitted together.
Figure 12:
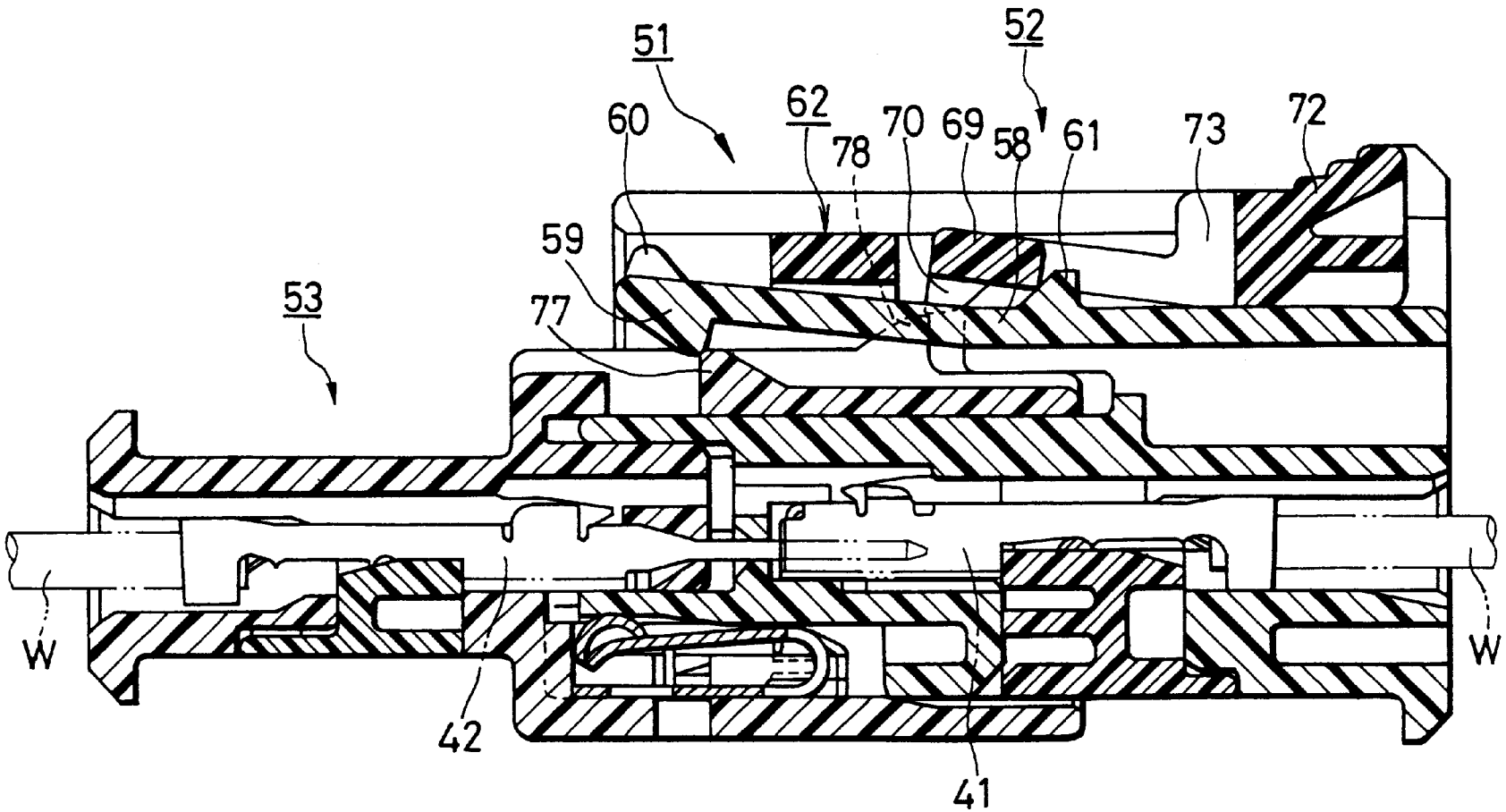
FIG. 12 PRIOR ART
FIG. 12 is a view showing a final stage of a half-fitted condition of the male and female connectors of FIG. 9.
Figure 13:
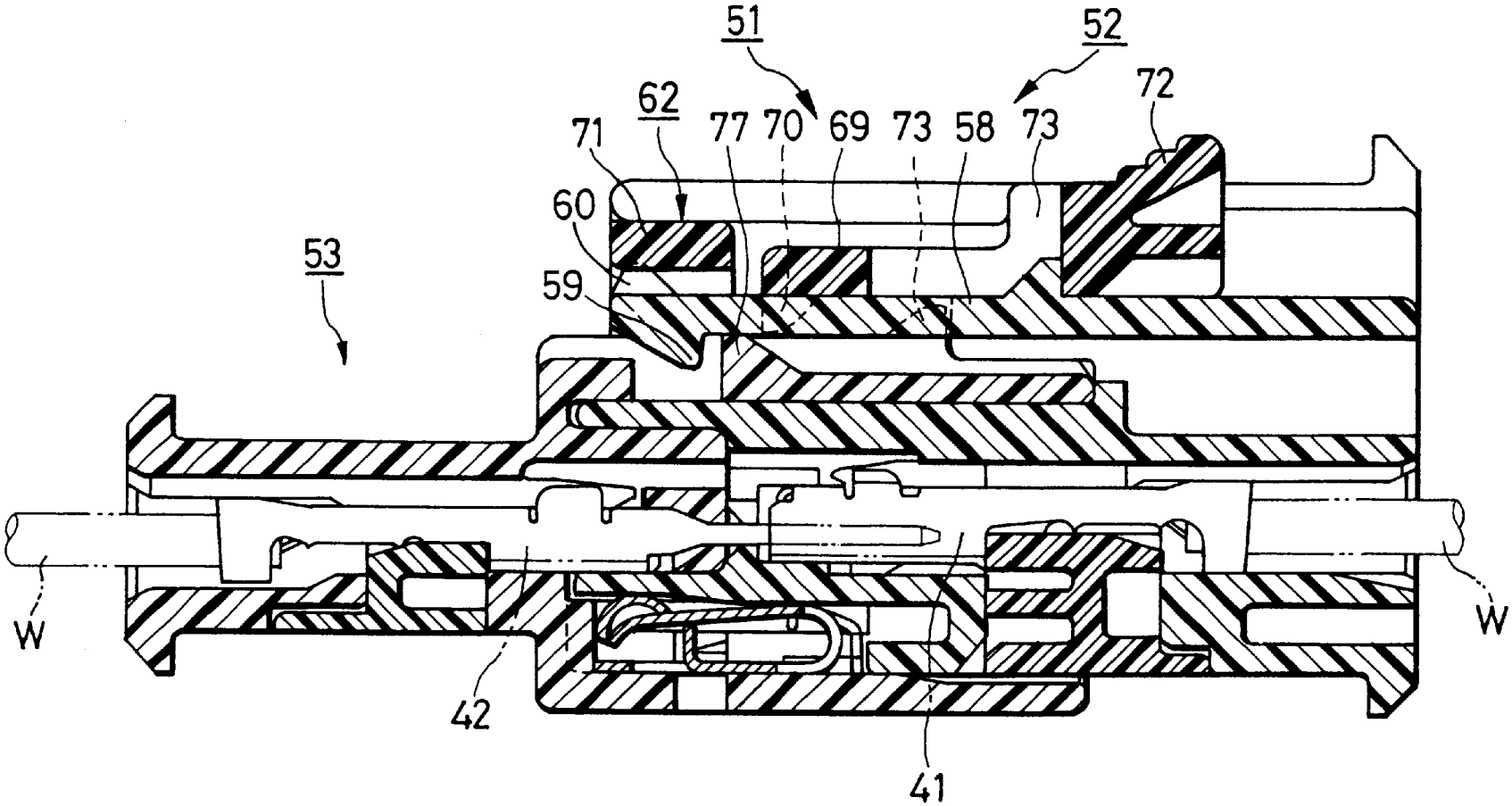
FIG. 13 PRIOR ART
FIG. 13 is a cross-sectional view showing a condition in which the male and female connectors are in a completely-fitted condition.
Figure 14:
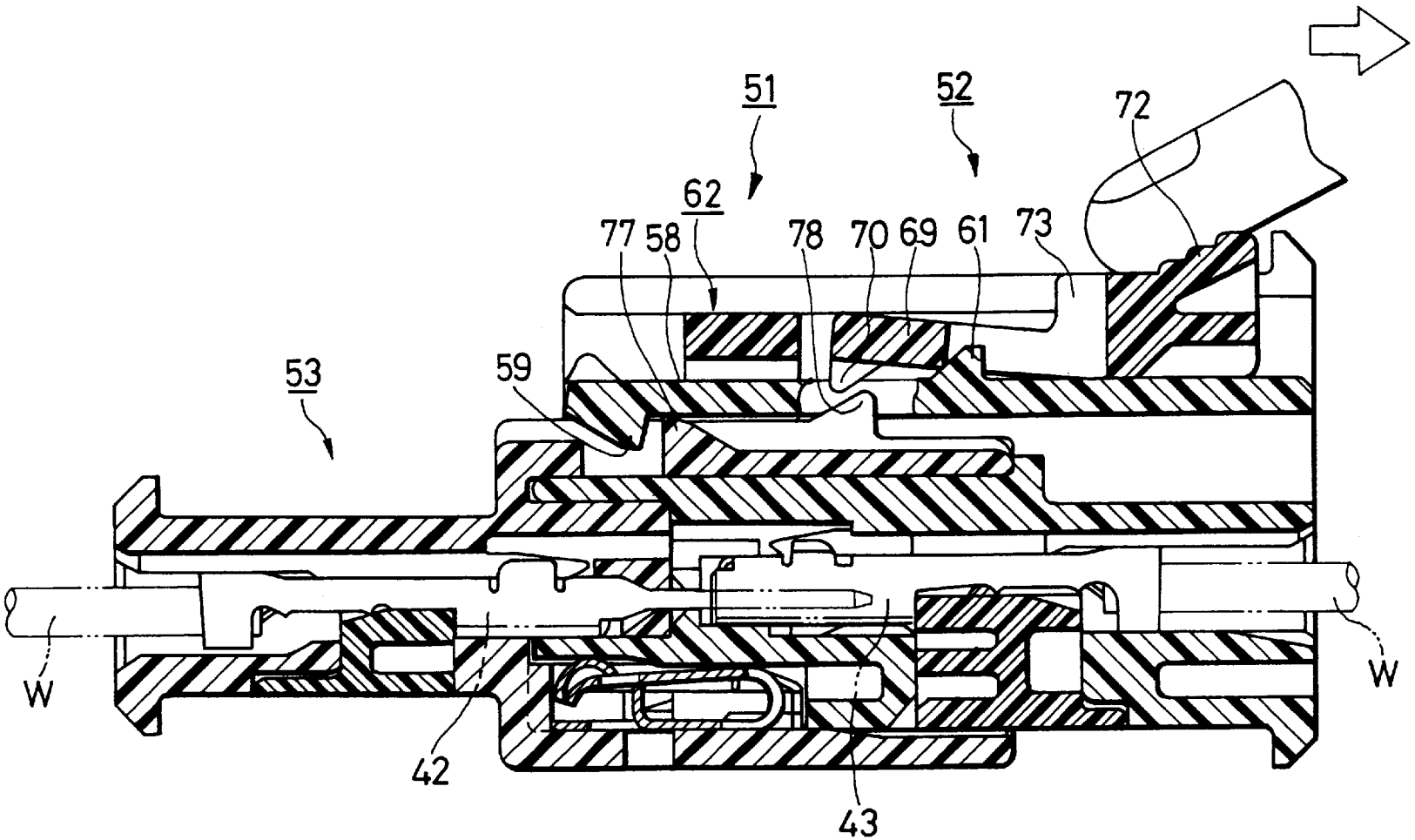
FIG. 14 PRIOR ART
FIG. 14 is a view showing a condition in which the cancellation of the fitting connection between the male and female connectors of FIG. 9 is started.
Figure 15:
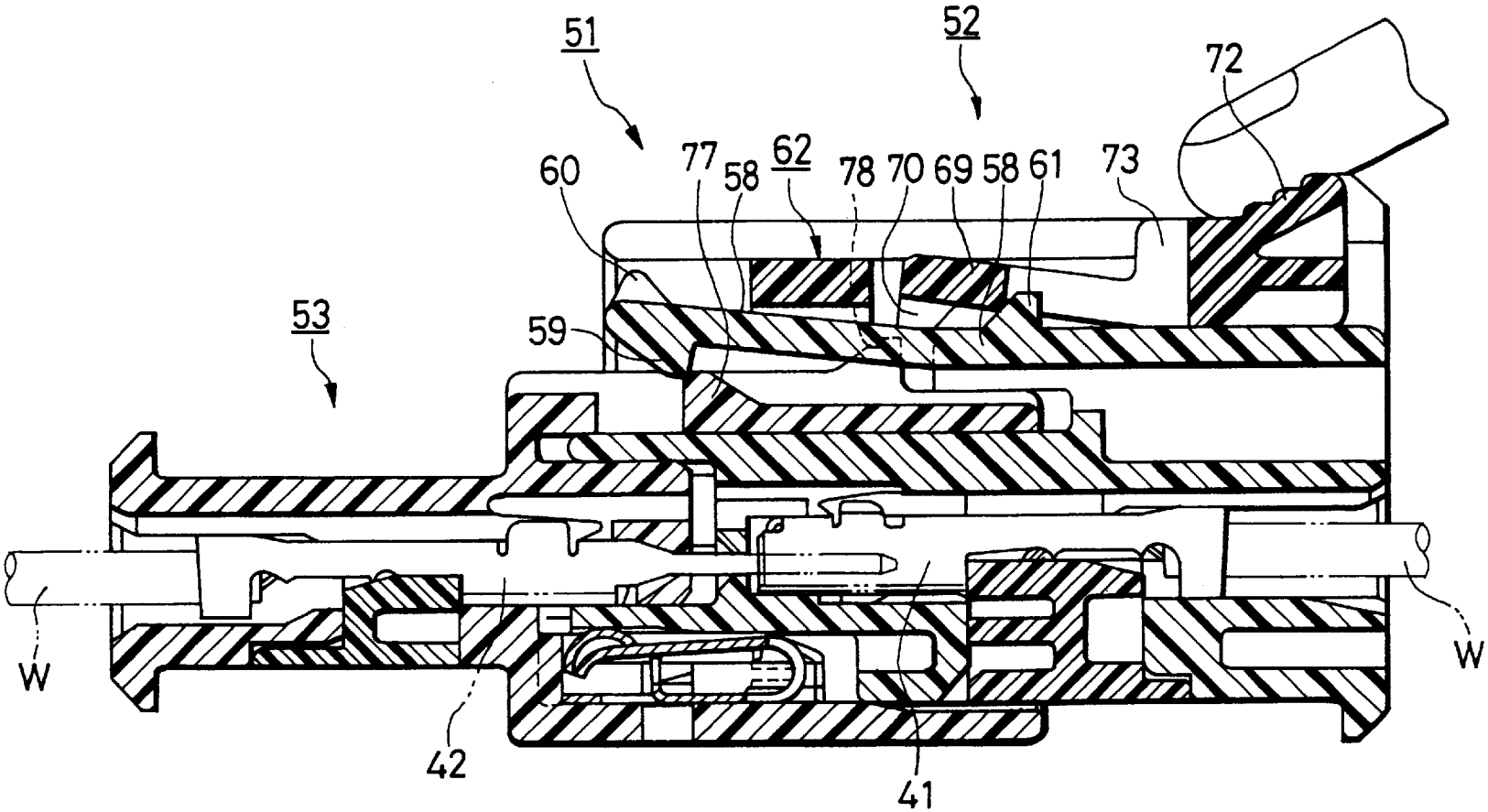
FIG. 15 PRIOR ART
FIG. 15 is a view showing a condition in which the cancellation of the fitting connection between the male and female connectors of FIG. 9 further proceeds.

Then, when the fitting operation further proceeds from the final stage of the half-fitted condition as shown in FIG. 7, the engagement projection 9 projects into the engagement window 23, and simultaneously with this, the engagement projection 9 is retained by the engagement plate 22. As a result, the elastically-deformed lock arm 10 is restored into its original condition, so that a completely-fitted condition is achieved. The front end of the compression spring portion 6 is disengaged from the front ends of the pressing projections 24, and is caused to impinge on the front holding portion 18 by the resilient force. However, the gap δ is formed between the two, and besides the spring member 5 is retained in the rear position by the resiliently-bendable portion 8 and the retaining portion 32. Therefore, the spring vibration of the compression spring portion 6 is attenuated in the gap δ, so that damage of the housing 4 is positively prevented.

For canceling the completely-fitted condition, the housings 4 and 21 of the male and female connectors 2 and 3 are held with the hands, respectively, and are moved away from each other while pressing the engagement projection 9 with the finger. As a result, this operation proceeds in a manner reverse to that described above for the fitting operation, and the completely-fitted condition is canceled.

However, when the lock arm 10 is elastically deformed downwardly, so that the bottom 14 is moved downward, the front portion of the compression spring portion 6 remains supported on the pressing projections 24 of the female connector 3, and therefore the compression spring portion 6 inevitably moves in the movement-enabling space 13 within the receiving chamber 11. Therefore, during the fitting connection-canceling operation, the compression spring portion 6 is kept in a free, no-load condition. Thus, the resilient force of the compression spring portion is not exerted, and therefore the force, required for disengaging the male connector from the female connector 3 while elastically deforming the lock arm 10, is small.

In the half-fitting prevention connector 1 of this embodiment having the above construction, the spring member 5 is held in the lock arm 10, and there is provided the receiving chamber 11 having the movement-enabling space 13, and the mating female connector 3 includes the pressing projections 24 which abut against the spring member 5 to compress the same when the lock arm 10 is elastically displaced during the fitting operation. Therefore, the conventional slider and the associated housing structure are simplified, and therefore the number of the component parts is small, and the production cost can be reduced.

And besides, when canceling the locked condition, the spring member 5 does not follow the elastic displacement of the lock arm 10, and therefore when canceling the fitting connection, it is not necessary to pull the engagement projection back against the bias of the spring member 5, and therefore the fitting connection-canceling operation is easy. Therefore, the efficiency of the fitting connection-canceling operation is enhanced.

The spring member 5 includes the coil-shaped compression spring portion 6, and the rear end portion of this compression spring portion 6 is twisted perpendicularly to the axis thereof to form the torsion spring portion 7, and the resiliently-bendable portion 8 extends obliquely forwardly from the torsion spring portion 7. Therefore, the spring member 5 can be pressed against the bottom 14 of the receiving chamber 11 by this resiliently-bendable portion 8. Therefore, noises will not be produced by vibrations of a vehicle and other factors, so that the reliability of the half-fitting prevention connector is enhanced.

Alternatively, the spring member 35 includes the compression spring portion 36, comprising a strip bent into a zigzag (or corrugated) shape, the folded-back portion 37 formed at the rear end of the compression spring portion 36, and the strip-like, resiliently-bendable portion 38 extending obliquely forwardly from the folded-back portion 37. This spring member can be produced more easily than the coil-shaped spring member 5, and the productivity of the spring members can be enhanced.

The abutment portion 31, abutted against the distal end of the resiliently-bendable portion 8, and the rear holding portion 15, holding the torsion spring portion 7 or the folded-back portion 37 in the predetermined direction, are provided in the receiving chamber 11. Thus, the direction of the resiliently-bendable portion 8 is fixed, and therefore the spring member 5 can be positively pressed against the bottom 14 of the receiving chamber 11. Therefore, noises will not be produced by vibrations of the vehicle and other factors, so that the reliability of the half-fitting prevention connector is further enhanced.

When the spring member 5 is held in a free condition between the rear holding portion 15 and the front holding portion 18 within the receiving chamber 11, the gap δ is formed between the front end of the spring member 5 and the front holding portion 18, and the retaining portion 32, which retains the front end of the resiliently-bendable portion 8, is formed at the abutment portion 31.

When the connector is shifted from the half-fitted condition to the completely-fitted condition, the spring member 5 is disengaged from the pressing projections 24, and is restored into the set condition. The spring member 5 is retained by the retaining portion 32, and since the gap δ is formed between the front end of the spring member 5 and the front holding portion 18, the impact force, produced when the front end of the spring member 5 impinges on the front holding portion 18, is reduced. Therefore, part of the housing 4, such as the lock arm 10, will not be damaged by such an impact, and the durability and reliability of the half-fitting prevention connector are enhanced.

The half-fitting prevention connector of the present invention is not limited to the above embodiment, but suitable modifications can be made. For example, in this embodiment, although the female terminals 41 are received respectively in the terminal receiving chambers 20 in the male connector while the male terminals 42 are received respectively in the terminal receiving chambers 25 in the female connector, the half-fitting prevention connector may have such a construction that the female terminals 41 are received in a female connector while the male terminals are received in a male connector.

As described above, in the half-fitting prevention connector of the above construction, the receiving chamber, in which the spring member is held, is formed within the lock arm, and the receiving chamber has the movement-enabling space, and the mating connector has the pressing portions which abut against the spring member to compress the same when the lock arm is elastically displaced during the fitting operation. Therefore, the provision of a slider is not necessary, and the number of the component parts is reduced, and the construction is simplified. Therefore, the production cost of the half-fitting prevention connector can be reduced.

And besides, when canceling the locked condition, the spring member does not follow the elastic displacement of the lock arm. Therefore, when canceling the fitting connection, it is not necessary to pull the engagement projection back against the bias of the spring member, and therefore the fitting connection-canceling operation is easy. Therefore, the efficiency of the fitting connection-canceling operation is enhanced.

The spring member includes the coil-shaped compression spring portion 6, and the rear end portion of this compression spring portion is twisted perpendicularly to the axis thereof to form the torsion spring portion, and the resiliently-bendable portion extends obliquely forwardly from the torsion spring portion. Therefore, the spring member can be pressed against the bottom of the receiving chamber by this resiliently-bendable portion. Therefore, noises will not be produced by vibrations of the vehicle and other factors, and the reliability of the half-fitting prevention connector can be enhanced.

Alternatively, the spring member includes the compression spring portion, comprising a strip bent into a zigzag (or corrugated) shape, the folded-back portion formed at the rear end of the compression spring portion, and the strip-like, resiliently-bendable portion extending obliquely forwardly from the folded-back portion. With this construction, the productivity of the spring members can be enhanced.

The abutment portion, abutted against the distal end of the resiliently-bendable portion, and the rear holding portion, holding the torsion spring portion or the folded-back portion in the predetermined direction, are provided in the receiving chamber. Thus, the direction of the resiliently-bendable portion is fixed, and therefore the spring member can be positively pressed against the bottom of the receiving chamber. Therefore, noises will not be produced by vibrations of the vehicle and other factors, so that the reliability of the half-fitting prevention connector is further enhanced.

When the spring member is held in a free condition between the rear holding portion and the front holding portion within the receiving chamber, the gap is formed between the front end of the spring member and the front holding portion, and the retaining portion, which retains the front end of the resiliently-bendable portion, is formed at the abutment portion. When the connector is shifted from the half-fitted condition to the completely-fitted condition, the spring member is disengaged from the pressing projections, and is restored into the set condition. The spring member is retained by the retaining portion, and since the gap is formed between the front end of the spring member and the front holding portion, a impact force, produced when the front end of the spring member impinges on the front holding portion, is reduced. Therefore, the lock arm and the housing will not be damaged by such an impact transmitted thereto, and the durability and reliability are enhanced.

What is claimed is:

1. A half-fitting prevention connector, comprising:

a first connector housing;

a second connector housing fittable to the first connector housing;

a spring member receivable in the first connector housing, wherein a half-fitted condition of the first and second connector housings is prevented by a resilient force of the spring member;

a lock arm elastically-deformably supported on the first connector housing, the lock arm having an engagement projection for retaining the second connector housing;

a receiving chamber, in which the spring member is held, formed within the lock arm, the receiving chamber having a movement-enabling space for allowing movement of the spring member; and a pressing portion disposed on the second connector housing, the pressing portion abutting against the spring member to compress the spring member when the lock arm is elastically displaced during a fitting operation of the first and second connector housings, wherein when canceling a locked condition of the lock arm, the spring member does not follow an elastic displacement of the lock arm.

2. A half-fitting prevention connector according to claim 1, wherein the spring member includes:

a coil-shaped compression spring portion, a torsion spring portion, wherein a rear end portion of the compression spring portion is twisted perpendicularly to an axis thereof to form the torsion spring portion, and a resiliently-bendable portion extending obliquely forwardly from the torsion spring portion.

3. A half-fitting prevention connector according to claim 1, wherein the spring member includes:

a compression spring portion comprising a strip bent into a zigzag shape, a folded-back portion formed at a rear end of the compression spring portion, and a strip-like, resiliently-bendable portion extending obliquely forwardly from the folded-back portion.

4. A half-fitting prevention connector according to claim 3, further comprising:

an abutment portion abutted against a distal end of the resiliently-bendable portion; and a rear holding portion holding the folded-back portion in a predetermined direction, wherein the abutment portion and the rear holding portion are disposed in the receiving chamber.

5. A half-fitting prevention connector according to claim 2, further comprising:

an abutment portion abutted against a distal end of the resiliently-bendable portion; and a rear holding portion holding the torsion spring portion in a predetermined direction, wherein the abutment portion and the rear holding portion are disposed in the receiving chamber.

6. A half-fitting prevention connector according to claim 4, wherein when the spring member is held in a free condition between the rear holding portion and a front holding portion within the receiving chamber, a gap is formed between a front end of the spring member and the front holding portion, and wherein a retaining portion, which retains a front end of the resiliently-bendable portion, is formed at the abutment portion.

7. A half-fitting prevention connector according to claim 5, wherein when the spring member is held in a free condition between the rear holding portion and a front holding portion within the receiving chamber, a gap is formed between a front end of the spring member and the front holding portion, and wherein a retaining portion, which retains a front end of the resiliently-bendable portion, is formed at the abutment portion.

* * * * *